US005210804A

United States Patent [19]

Schmid

[11] Patent Number: 5,210,804

[45] Date of Patent: May 11, 1993

[54] SOLAR POWERED HEARING AID AND REENERGIZER CASE

[76] Inventor: Guenther W. Schmid, 126-06 Jamesville Ave., Syracuse, N.Y. 13210

[21] Appl. No.: 670,574

[22] Filed: Mar. 18, 1991

[51] Int. Cl.[5] ..... H04R 25/00

[52] U.S. Cl. ..... 381/69.2; 381/68; 381/69; 136/291

[58] Field of Search ..... 381/69, 69.2, 68, 68.6; 136/256, 291; 237/14; 435/809; 40/574; 355/230, 231, 210; 320/2; 362/154

[56] References Cited

U.S. PATENT DOCUMENTS

| | | | |
|---|---|---|---|
| 2,901,551 | 8/1959 | Passow . | |
| 2,950,357 | 8/1960 | Mitchell et al. . | |
| 3,007,110 | 10/1961 | Rosenstrach | 324/53 |
| 3,818,691 | 6/1974 | Uchiyama | 136/256 |
| 3,921,049 | 10/1975 | Mellors et al. . | |
| 4,379,988 | 4/1983 | Mattatall . | |
| 4,800,803 | 1/1989 | Farmont | 136/291 |
| 4,882,239 | 11/1989 | Grimmer et al. | 136/291 |

FOREIGN PATENT DOCUMENTS

| | | | |
|---|---|---|---|
| 3501448 | 8/1985 | Fed. Rep. of Germany | 381/68 |

OTHER PUBLICATIONS

"The Dawn of a New Era in Hearing. The SA-2000 Solar-Energized Hearing Aid", Solar Aid Corp.

Technological Reports "The rechargable hearing instrument system" Toni Gitles, vol. 38, No. 7 1987 pp. 16 and 17.

*Primary Examiner*—Jin F. Ng
*Assistant Examiner*—Huyen D. Le

[57] ABSTRACT

In-the-ear type hearing aid has a rechargeable storage cell permanently connected and permanently situated within its shell, and a solar cell carried on its back plate and facing outward. The solar cell provides power to energize the hearing aid amplifier while the device is worn and also reenergizes the storage cell under average ambient conditions. The solar cell serves as a noise filter to reduce the background noise apparent to the wearer. A semi-transparent cover or door cosmetically conceals the solar cell while the aid is being worn, but permits some ambient light to penetrate to the solar cell. For recharging, the door can be opened for full exposure on to the solar cell. A combination storage and reenergizing case is provided for the hearing aids.

7 Claims, 4 Drawing Sheets

SOLAR POWERED HEARING AID AND REENERGIZER CASE

BACKGROUND OF THE INVENTION

This device relates to apparatus for the hearing impaired, and is more particularly directed to hearing aids. The invention is specifically directed to hearing aids of the type containing a rechargeable battery or power source, and containing means for recharging or reenergizing the battery or power source.

A number of rechargeable hearing aids have been recently introduced, and these have found favor particularly among those for whom, because of arthritis or other physical impairment, battery replacement is a problem.

As is well known in this field, conventional hearing aid batteries require periodic replacement, with a battery typically lasting no more than two weeks to a month. However, those hearing-impaired persons needing an aid are often afflicted with arthritis and may have trouble manipulating the battery into the case. Also, many hearing aid wearers often forget to purchase batteries, or find it inconvenient to get out to obtain them. Batteries also represent an ongoing expense, and many hearing-impaired persons are required to live on a rather stringent budget.

The incorporation of a rechargeable cell or battery into a hearing aid has alleviated this problem somewhat, and two types of rechargeable hearing aids have been introduced, the direct plug-in type and the inductively rechargeable type. The direct plug-in type requires the wearer to plug a charger directly into a socket on the hearing aid, and apply recharging current directly to the battery. The inductively rechargeable type of hearing aid is simply dropped into a recharger, which produces an AC magnetic field. This oscillating field is then converted, by the hearing aid, to a direct current which recharges the hearing aid battery. In both cases, the rechargeable battery is permanently incorporated, and is entirely within the case or shell.

An inductively rechargeable hearing aid and recharging stand is described in Mattatall U.S. Pat. No. 4,379,988. Aids of this type tend to have a high failure rate because of the large induction currents generated during a recharge cycle and also because of high temperature from inductive heating.

An eyeglass-type hearing aid which employs a solar or photovoltaic cell for operation is described in Passow U.S. Pat. No. 2,901,551. These aids have not become particularly popular, in part because of a tendency towards "motorboating" noise, and in part because the aid could not be made to look attractive.

While these types of aids have been an improvement, it often happens that wearer is away from home or may forget his or her recharger. Further, the wearer is limited as to where he or she can travel, as the recharger must be plugged into a standard power source, which may not be available if the wearer travels abroad, or for example, goes on an extended camping or fishing trip.

OBJECTS AND SUMMARY OF THE INVENTION

Accordingly, it is an object of this invention to provide a rechargeable hearing aid which avoids the drawbacks of prior art rechargeable aids.

It is another object of this invention to provide a hearing aid which does not require the use of a special charger device.

It is yet another object, on the other hand, to provide a reenergizer case which is simple and durable, and which will double as a storage and carrying case.

It is still another object of this invention to provide a hearing aid which derives its operating power directly from ambient light.

It is a further object of this invention to provide a hearing aid which has its solar cell covered with a panel of semitransparent material, so that on the one hand the aid will produce a natural, unobtrusive appearance, while on the other hand ambient light will continue to provide at least some of the operating current for the hearing aid.

It is still a further object of this invention to provide a hearing aid in which the solar cell and storage cell serve to filter or eliminate background noise, so that the wearer enjoys increased success in hearing, even in adverse, noisy environments.

In keeping with the above objects, the hearing aid of this invention has a case or shell, a pick-up transducer or microphone for converting ambient sound to an electrical signal, an amplifier within the case or shell for amplifying the output of the pick-up transducer, an acoustical output transducer or receiver that is coupled to the amplifier output for delivering amplified sound into the auditory canal of a wearer, and a power cell within the case or shell for providing the electrical power to the amplifier. According to this invention, the power cell includes a rechargeable storage cell permanently situated within the case or shell, and a photocell, such as a thin-film amorphous silicon or a GaAs solar cell, that has its photosensitive surface exposed to the outside of the shell. The photocell is connected in parallel with the storage cell and is of sufficient power capacity to power the amplifier and to recharge the storage cell under average ambient light conditions. The storage cell is of sufficient capacity to power the amplifier for the wearer under night or darkness conditions for at least several hours.

In a favorable embodiment, the storage cell is a nickelcadmium cell with a nominal capacity of between 10 and 30 milliampere hours, and the photocell or solar cell has a full-sun currant capacity on the order of two milliamperes. A protective diode can be disposed between the storage cell and the solar cell, but, in the case of the preferred solar cell, the dark resistance is high enough that this protective diode can simply be omitted.

The aid has a semitransparent door which closes over the solar cell for wearing, and opens to fully expose the solar cell for reenergizing. The door is a semitransparent plastic colored to match the color of the hearing aid and the skin color of the wearer, and also permitting some ambient light to penetrate to the solar cell.

This arrangement also filters out or eliminates much of the background noise that accompanies conventional, dry cell powered in-the-ear aids.

A combination carrying case and reenergizer for one or more aids is in the form of a box having a base portion and a lid that hingedly opens and closes over the base. The base portion has receptacles which can be used for storing two in-the-ear aids, and a reenergizing stand on which the aids are placed for reenergizing by artificial illumination. At this location on the base portion of the case there is a lamp recess and a pair of lamp assemblies in the recess. Each lamp assembly includes a lamp receptacle or socket, a mount that affixes the lamp receptacle to a floor of the base, a lamp that fits into the receptacle, and a reflector that is removably fitted in the base portion and around the lamp to direct its light upwards. A support shelf on the reenergizing stand above the lamps holds one or two aids during recharging or reenergizing. The shelf preferably has clear plastic window, with venting slots and recesses to position the aids. The carrying case can also contain a power supply for the lamps.

The hearing aid wearer wears the aid in the ear when hearing assistance is needed, and the door is closed over solar cell during that time. The semi-transparent door permits a sufficient fraction of ambient light to reach the solar cell so that the solar cell produces at least some of the electrical power required to run the aid. At the end of the day, the wearer removes the hearing aid, and places the aid with its door open onto the reenergizing stand in the carrying case, or in the light from another suitable source of artificial light.

The wearer can keep track of what days to recharge the aid by means of a reminder slide or dial on the lid of the case.

In an alternative embodiment, an in-the-ear aid can have the solar cell embedded in the molded shell rather than in the fare plate. This gives the interior of the shell additional room for electronics and can accommodate a larger storage cell. The solar cell itself can be larger to facilitate reenergizing when out of the car. Also, there is more space available on the face plate for controls.

The above and many other objects, features, and advantages of this invention will be more fully understood from the ensuing detailed description of a preferred embodiment, which is to be considered in connection with the accompanying drawing.

DETAILED DESCRIPTION OF THE PREFERRED EMBODIMENT

Figure 1:
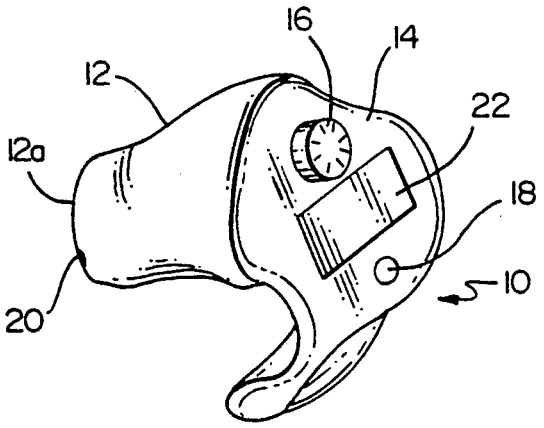
FIG. 1 is a perspective view of an in-the-ear hearing aid according to one embodiment of this invention.

With reference to the drawing, and initially to FIG. 1 thereof, an in-the-ear (ITE) hearing aid 10 is shown to have a shell 12 molded to fit the ear of an individual wearer. This shell has a projection 12a which fits into the auditory canal of the wearer. The aid 10 also has a back plate 14 affixed on the outward side of the shell 12. The plate 14 carries a volume control knob 16, which is turned to raise or lower the volume, and also controls on/off switch. This knob 16 is shown as an example, and another arrangement, such as a digital touch-switch volume control, could be substituted.

A microphone or pick-up 18 is disposed at an opening in the back plate 14, and a receiver 20 or audio output transducer is disposed at a hole in the end of the shell projection 12a.

A solar cell 22, which here comprises a wafer of amorphous silicon, is disposed on the backplate 15 and has a photosensitive surface at least partly exposed externally on the plate 14 so that the solar cell 22 will produce electrical current when illuminated in ambient light.

Figure 2:
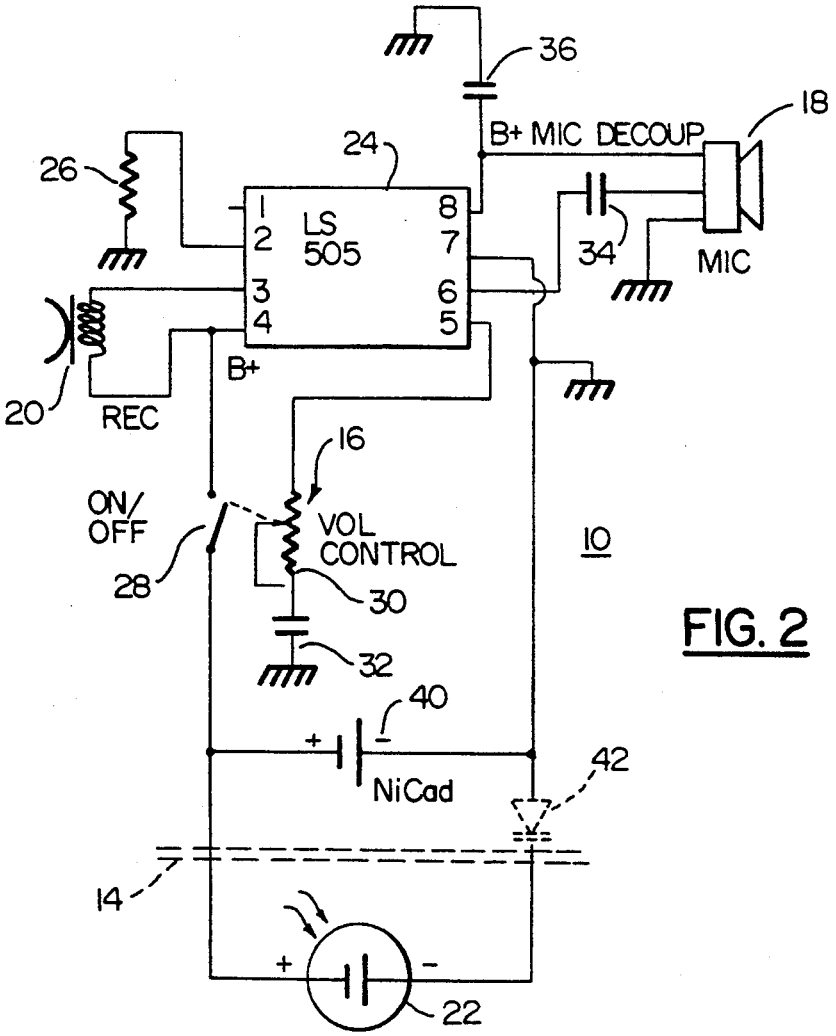
FIG. 2 is a circuit diagram of the hearing aid of this invention.

As shown in the circuit diagram of FIG. 2, the aid 10 has a hearing aid power amplifier 24, which in this case is a type LS 505 CMOS module, with pin terminals numbered 1 through 8. Pin number 1 is a peak clipping terminal, and is optionally connected to a voltage reference where the total signal amplitude must be limited. Pin 2 is connected to ground through a resistor 26. Pins 3 and 4 are coupled across input of the receiver 20, and pin 4 is also employed as a power input terminal to receive battery voltage B+.

An on/off switch 28 is connected to pin 4 of the amplifier 24, and this switch 28 is coupled to the slider of a variable resistor 30 which serves as the volume control element 16. The resistive element of the volume control variable resistor 30 is connected on one side to pin 5 of the amplifier 24, and on the other side, through a series capacitor 32, to ground. Pin 6 of the amplifier 24 if coupled through a capacitor 34 to an audio output of the microphone 18. Pin 7 serves as a grounding pin. Pin 8 provides a decoupled mic battery B+to a decoupled power input of the microphone 18, and for this reason, an integrating capacitor 36, here for example, of a capacitance of ten microfarads, is coupled between pin 8 and ground. A rechargeably nickel-cadmium (Nicad) storage cell 40 has its negative terminal connected to pin 7, i.e. to ground, and has its positive terminal coupled, through the on/off switch 28, to pin 4 to supply the voltage B+thereto. This rechargeable storage cell 40 is permanently connected, and, as is illustrated, is entirely inside the shell 12, that is, entirely behind the back plate 14. All connections are permanently connected, e.g., soldered, so there is no contact noise.

As is further illustrated, the solar cell 22 has its positive and negative terminals coupled to the terminals of the Nicad rechargeable storage cell 40, but the solar cell 22 is disposed externally of the back plate 14. As indicated in ghost lines, an optional protective diode 42 can be included in circuit between the Nicad cell 40 and the solar cell 22.

The solar cell 22 has a nominal full-sun capacity of two milliamps, and, under worst-light conditions, will produce a current on the order of 200 to 800 microamps. The amplifier 24 has a low current draw, generally on the same order of 200 to 280 microamps, and the amplifier 24 can be built to match the power of the solar cell 22. The rechargeable Nicad storage cell 40 has a normal storage capacity of 20–30 milliampere hours (mah), although for many wearers a storage cell of 10 mah will suffice.

Under normal ambient outdoor light conditions, the solar cell 22 will maintain the charge the storage cell 40, and if the aid is simply left out in the sun it will recharge in a few hours. If recharging is required at night, the wearer can simply remove the hearing aid 20 from his or her ear, and expose it to artificial light overnight.

Instead of the amorphous silicon solar cell 22, a gallium arsenide (GaAs) cell can be employed. These cells are somewhat more expensive, but there is a considerable advantage in power output. Other high-performance solar cells are also available.

The solar cell/rechargeable battery hearing aid 10 of this invention obviates the aforementioned problem many wearers experience, namely forgetting to purchase batteries, forgetting to recharge, or inability to recharge when away from home, or inability to manipulate a new battery to fit into the aid. Instead, the "recharger" solar cell 22 is built into the device, and the rechargeable storage cell 40 is a permanent part of the device. No charger needs to be electrically connected, as the hearing aid 10 recharges on light alone. These devices are sturdy enough to enjoy a warranty period of two years or more, and preferably the devices are factory serviceable, not serviceable by a customer or dealer.

In the particular embodiment depicted in FIG. 1, the cell 22 is a small amorphous silicon solar cell, having a length and a width of 7 millimeters, and thickness of 1.1 millimeters. The minimum characteristics at one-tenth of full sun are 0.9 volts and 200 microamps. The small built-in storage cell 40 is favorably a Nicad cell having a capacity of 10 to 30 mah at 1.2 volts. The case dimensions of the cell 40 are 8–12 millimeters by about 5 millimeters.

The charging and discharging characteristic of the cells 22 and 40 of the above-described embodiment of the hearing aid 10 are set forth in the attached table, both for a rather large current drain (Id=0.680 ma) and for a normal current drain (Id=0.280 ma). Under darkness conditions, and under maximum draining, the hearing aid will continue to operate penetrate for over 10 hours. In the case of high (0.680 ma) drain, the solar cell 22 will power the hearing aid and will actually charge the storage cell 40 for ambient light conditions of about 40 percent or more full sun. In the case of the normal drain 0.280 ma, the solar cell will power the hearing aid and will recharge the storage cell 40 for ambient conditions beginning at about 20 percent fully sun.

The solar-cell powered hearing aids of this invention have been found to have improved low-noise characteristics. Many wearers have found it easier to listen to speech or music, especially in noisy or crowded environments, with the hearing aid of this invention, while the same wearers had experienced difficulty hearing when employing a standard, battery-powered aid. This is believed to come about because of a filtering action in the solar cell 22, which is electrically in parallel to the storage cell 40 and is also connected at one end to the audio transducer 20. That is, the hearing aids of this invention suppress background and static noise because the solar cell and rechargeable battery are permanently connected in parallel in circuit with the hearing aid electronics. The solar cell in parallel with the nickel cadmium battery and amplifier appears to cancel out random battery noise.

As aforementioned the principles involved here are not limited to the ITE hearing aid shown in FIG. 1, but can be employed favorably in any type of hearing aid. For example, in a behind-the-ear aid, an array of solar cells 22 can provide an increased current output. This enable the hearing aid to have additional gains to combat excessive hearing losses.

Figure 3:
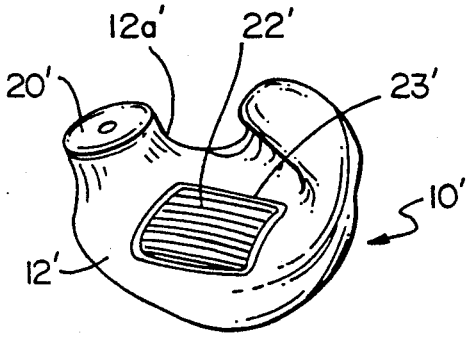
FIG. 3 is a perspective view of an additional embodiment of the invention.

One useful variation of this invention is shown in FIG. 3, which shows the shell 12' of an in-the-ear aid 10.' Here, the solar cell 22' is molded into the shell 12' and faces into the wearer's ear when it is being worn. Also shown here are the earphone or receiver 20' on the auditory canal projection **12*a*.' In this configuration there is considerably more space for the solar cell than is available on the back plate (not shown here). The dark colored solar cell is not visible when the aid 10' is being worn. With the solar cell 22' embedded in the shell, there is more room on the interior of the shell 12' to accommodate a larger storage battery or more powerful or sophisticated electronics, as desired. To form the shell, the solar cell is placed into the mold and then covered with a clear plastic, followed by the colored plastic to match the wearer's skin color. This creates a clear window 23' in the shell over the solar cell 22.'** The aid can be reenergized under artificial light or in sunlight.

Figure 4:
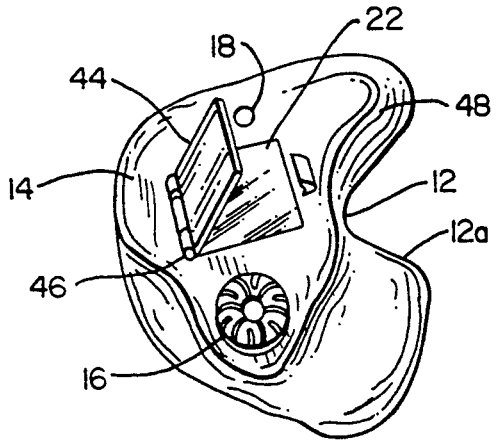
FIG. 4 is a perspective view of an in-the-ear hearing aid according to another embodiment of this invention.

An improved version of the hearing aid 10 is shown in FIG. 4, which is for the most part identical with the aid of FIG. 1, and in which the hearing aid 10 has its shell 12 with a portion **12*a* to fit into the canal of the outer ear, and its back plate 14 having the solar cell 22 situated on it. The volume control 16 and the microphone inlet port 18 are also shown as in FIG. 1. In this version there is also a door 44 connected by a hinge 46 to the back plate 14, and which closes over the solar cell 22 to the back plate 14, and which closes over the solar cell 22 and is held closed by means of a latch 48**.

The door 44 serves the purpose of concealing the solar cell 22 for cosmetic purposes, but is constructed of a material which is thin and semi-transparent so that at least some ambient light will penetrate through the door and cause the solar cell 22 to generate a significant fraction of the power used by the amplifier 24 when the aid is being worn.

Generally, the photocell or solar cell 22 is a dark blue, black, or blue grey square, while the back plate 14 is cosmetically colored of a toned material that generally matches the skin color of the wearer. The plastic material employed for the plate or door 44 has its color selected to blend with the skin color of the wearer and the color of the back plate 14.

Thus, when this hearing aid 10 is worn, with the door 44, in its closed position, the aid is not particularly noticeable in the ear. However, the door 44 can easily be opened by the wearer when it is desired to reenergize the aid by means of artificial (or natural) light.

Figure 5:
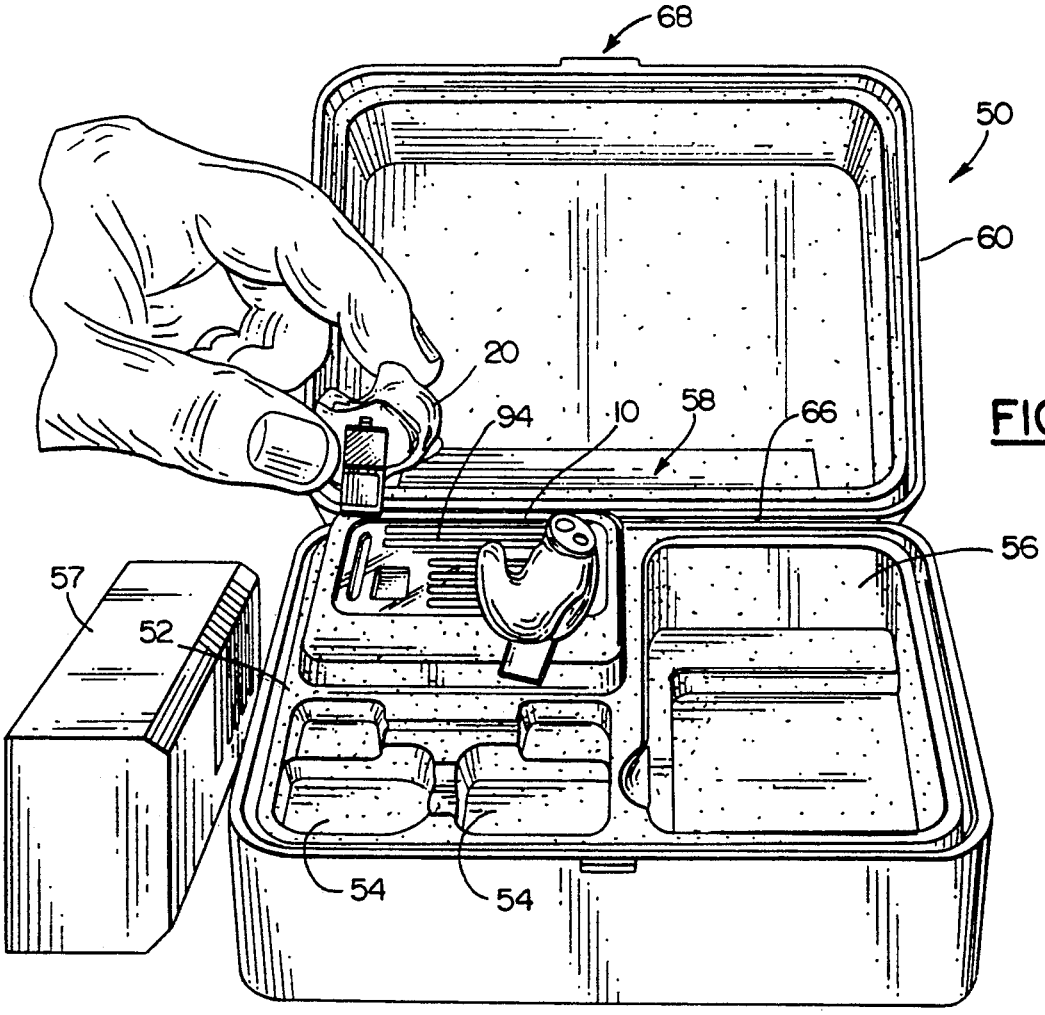
FIG. 5 is a perspective view of a carrying case/reenergizer that is employed in connection with the hearing aids in accordance with one embodiment of this invention.

FIG. 5 shows a combination reenergizer in storage case 50 which can be employed for reenergizing one or two of these hearing aids 10 at a time, as well as a storage case or traveling case for the hearing aids.

Figure 6:
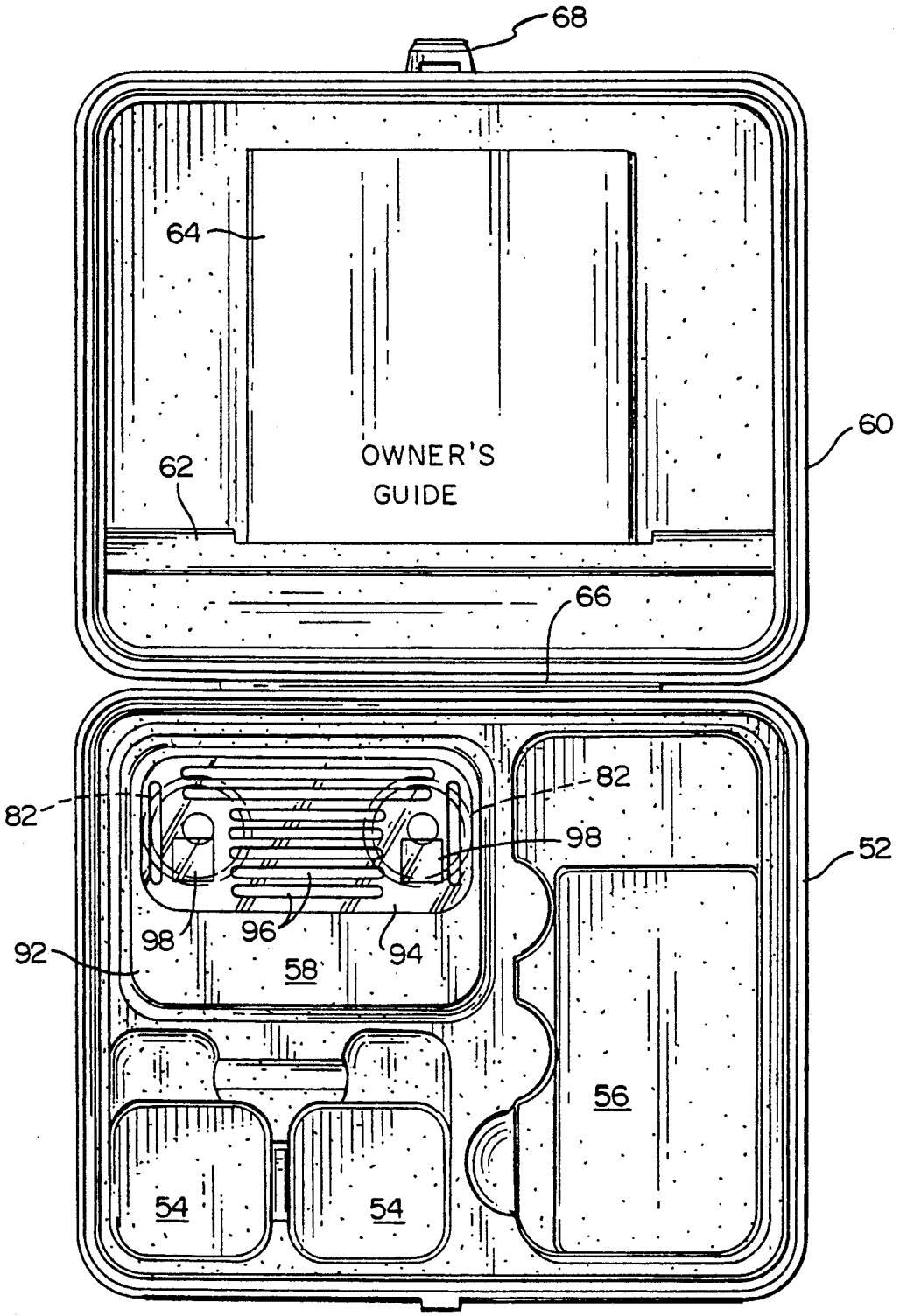
FIG. 6 is a top plan view of the case of FIG. 5, fully opened.
Figure 7:
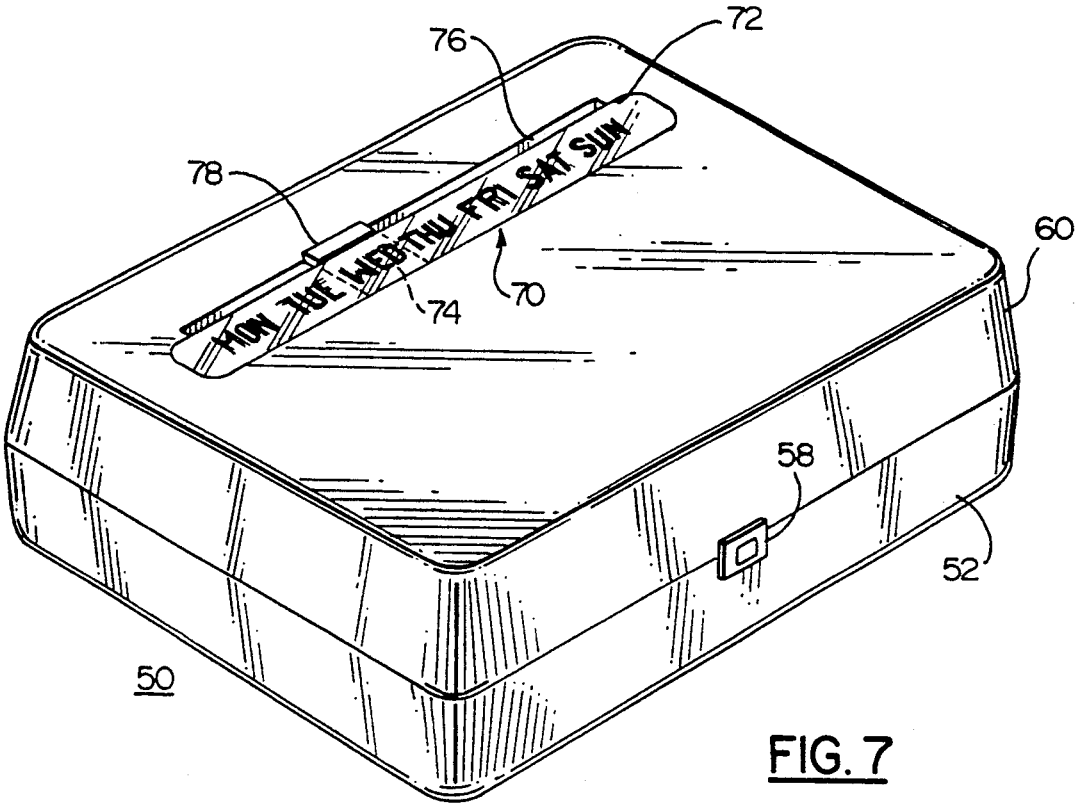
FIG. 7 is a perspective view of the case of FIG. 5, with its lid closed and featuring the reenergizer reminder slide.

The case 50 has a base portion 52 which has a pair of recesses 54 for storing the hearing aids. The case also has a receptacle 56 for holding an ac/dc converter and power supply 57 and which is employed to power the electric lights within a recharging stand 58 that is positioned to the rear of the storage recesses 54. A lid or top 60 also has a receptacle 62, better shown in FIG. 6, which can be used for holding a hearing aid owners manual 64 or a warranty card or other document. A hinge 66 connects the lid 60 to the base portion 52, and a latch 68 on a edge opposite the hinge 66 holds the lid closed on the base portion 52, as shown in FIG. 7. On an outer surface of the lid there is a reminder calendar indicator 70 to assist the hearing aid wearer in remembering the next time in which a full charge may be required for the hearing aids. This indicator 70 has an elongated date panel strip 72, here with windows cut through to indicated the various days of the week (i.e. "MON", through "SUN"). An indicator slide 74 is disposed behind the strip 72 in a recess 76 in the lid 60. This slide 74 has a width corresponding to the width of each window, and is of a contrasting color so as to be visible through the window. A handle portion 78 of the slide protrudes slightly above the surface of the lid and permits the wearer to move the indicator slide 74.

Figure 8:
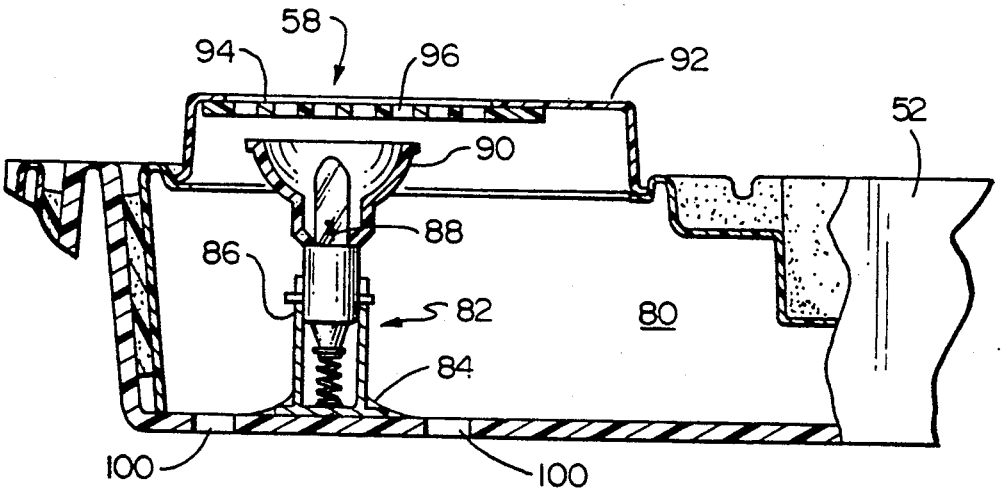
FIG. 8 is a sectional elevation of a reenergizer stand and lamp assembly of the case of this invention.

The details of the recharging stand 58 can be explained with reference to FIG. 8. The reenergizing stand 58 comprises a lamp recess 80 in the base 52. This recess 80 contains at least one lamp assembly 82, and in the preferred embodiment contains, a pair of lamp assemblies so that two hearing aids can be reenergized at the same time. As shown, e.g. in FIGS. 8 each lamp assembly has a mount 84 that is formed in the floor of the base portion 52, the mount having a lamp holder or socket 86 affixed to it. Each socket 6 is disposed vertically to receive a bayonet-type lamp 88. A parabolic reflector 90 is disposed over each lamp 88 to direct its light upwards. As shown in FIGS. 5, 6, and 8, the reenergizing stand 58 also includes a removable panel 92 serving as a support shelf, and having clear window 94 situated across an opening therein. A tough, durable plastic such as Lexan is preferred for this. The window 94 is provided with venting slots 96 and with recesses 98 to help position the hearing aids for reenergizing. Additional inlet vents 100 are provided in the floor or walls of the base 52.

The method use of the hearing aids 10 and the reenergizing and storage case 50 is rather straightforward. During the day, the wearer inserts one or both of the aids 10 in his or her ear, with the doors 44 being closed for cosmetically concealing the solar cell 22. During daylight hours and in most environments, there is sufficient light penetrating through the semitransparent door 44 to the solar cell 22 while the aid is being worn so that the solar cell produces at least a portion of the power required for operating the amplifier. When the stored charge on the storage cell 40 is depleted, e.g. at the end of the day, the wearer simply opens the door 44 after removing the aid 10 from his or her ear, and places the aid, with its panel 14 directed downwards, onto the screen 92 directly above a respective one of the lamp assemblies within the case 50. Electrical power from the power supply 57 is then connected to the case so to light the lamps 88. These lamps 88 produce only a limited amount of heat, so the lid 60 can be closed on top of the hearing aids during a reenergizing cycle. The lid provides sufficient internal clearance to accommodate the aid or aids on the support shelf. Then, after a sufficient time e.g., after the wearer arises the next morning, the case 50 is opened, and the hearing aids 10 can be removed and are ready for immediate use.

For most wearers, a daily reenergization is not required, but rather reenergization at two or three day intervals. During the intervening nights, the aids can be stored in the storage receptacles 54.

The exact configuration of the reenergization and storage case is not critical, so long as it can perform the required functions as described. Also, rather than a hinged door 44, a sliding cover or the like could be employed instead.

While this invention has been described in detail with respect to certain preferred embodiments, it should be understood that the invention is not limited to those precise embodiments. Rather, many modifications and variations would present themselves to those skilled in the art without departing from the scope and spirit of this invention, as defined in the appended claims.

What is claimed is:

1. An in-the-ear hearing aid of the type in which a shell is shaped to fit in a wearer's outer ear, the shell having a canal portion extending into the auditory canal of the wearer and a back plate facing outwards, the back plate being colored to match the skin color of the wearer, the aid comprising pickup transducer means in the shell for converting ambient sounds to an electrical signal, electrical amplifier means within the case for amplifying said electrical signal, acoustic output transducer means in the canal portion of the case coupled to an output of the amplifier means for delivering amplified sound into the auditory canal of the wearer, a rechargeable electrical storage cell permanently situated within said shell below said back plate, a photocell carried on said back plate and permanently connected in parallel with said storage cell and of sufficient power capacity to power the amplifier means in full sunlight and to contribute a substantial portion of the operating current for said amplifier means when said hearing aid is being worn in ambient outdoor daytime light conditions and to recharge said storage cell when the photocell is exposed to light when the aid is not in use, and comprising the improvement wherein a door formed of a semitransparent material is disposed on said back plate and colored to match the color of the back plate, said door being operable fully to expose the photocell there beneath and closable over said photocell for concealing and covering the photocell when the aid is being worn yet permitting a significant portion of incident light to penetrate to the photocell, and which can be opened to expose the photocell fully for reenergizing the storage cell when the aid is not being worn.

2. The hearing aid of claim 1 wherein said photocell includes a diode to prevent reverse bias discharging of the storage cell through the photocell when in darkness.

3. The hearing aid of claim 1 wherein said door is a hinge on one side for swingably connecting to said back plate and latch means which releasably mates with correspondingly means on said back plate.

4. A method of employing a hearing aid of the in-the-ear type in which a shell is shaped to fit in the wearer's outer ear, the case having a canal portion extending into the auditory canal of the wearer and a back plate facing outwards, the aid including pickup transducer means in the shell for converting ambient sound to an electrical signal, electrical amplifier means within the shell for amplifying said electrical signal, acoustic output transducer means in the canal portion of the shell coupled to an output of the amplifier means for delivering amplified sound into the auditory canal of the wearer, a rechargeable storage cell permanently situated within the shell for powering the amplifier means, a photocell carried on said back plate and connected in parallel with the storage cell and being of sufficient power capacity to power the amplifier means and recharge the storage cell under average ambient sunlight conditions, and a door on said back plate that is closable over the photocell for concealing and covering the photocell while the aid is being worn and openable for recharging to expose the photocell fully when the aid is not being worn, the door being formed of a semitransparent material which permits a significant amount of light to penetrate to the photocell under ambient daylight conditions; the method comprising the steps of:

wearing the aid in the ear when assistance in hearing is desired, including closing said door over said photocell and exposing the aid while the aid is worn to ambient light so that a fraction of the light incident on the door penetrates to the photocell such that the photocell produces at least a portion of the power for said amplifier means; and reenergizing the aid when out of the ear by opening said door to expose the photocell and placing the aid when its door opened into light from a source of artificial illumination.

5. The method of claim 4 wherein said source of artificial illumination includes a case having a lid and at least one lamp therein and a support screen over said lamp on which said aid can repose; and said step of reenergizing includes opening said lid, placing the aid on said support screen with the photocell facing down towards said at least one lamp.

6. The method of claim 5 further comprising storing the aid, when not in use, within said case.

7. An in-th-ear hearing aid of the type in which a shell is shaped to fit in a wearer's outer ear, the shell molded of a plastic resin and having a canal portion extending into the auditory canal of the wearer and a back plate colored to match the skin color of the wearer, the aid comprising pickup transducer means in the shell for converting ambient sound to an electrical signal, electrical amplifier means within the case for amplifying said electrical signal, acoustic output transducer means in the canal portion of the case coupled to an output of the amplifier means for delivering amplified sound into the auditory canal of the wearer, a rechargeable electrical storage cell permanently situated within said shell below said back plate, a photocell permanently connected in parallel with said storage cell and of sufficient power capacity to recharge said storage cell when the photocell is exposed to light when the aid is not in use; and the improvement which comprises the photocell being embedded in teh plastic resin of the molded shell to face into the ear when the aid is being worn, but which is exposed when the aid is out of the ear for reenergizing the aid when the aid is not being worn, wherein a portion of said plastic resin in which said photocell is embedded is clear, and the remainder thereof is colored to match the skin color of the wearer.

* * * * *